United States Patent [19]

von Wimmersperg

[11] 4,372,122

[45] Feb. 8, 1983

[54] PROPELLANT OPERATOR

[75] Inventor: Heinrich F. von Wimmersperg, 15721 Rosemont Rd., Detroit, Mich. 48223

[73] Assignee: Heinrich von Wimmersperg, Detroit, Mich.

[21] Appl. No.: 160,392

[22] Filed: Jun. 17, 1980

[51] Int. Cl.[3] ..... F01B 29/08

[52] U.S. Cl. ..... 60/634; 60/632; 60/637

[58] Field of Search ..... 60/634, 637, 632

[56] References Cited

U.S. PATENT DOCUMENTS 3,103,851 9/1963 Rosenblum et al. ..... 60/634 X 3,104,521 9/1963 Sawyer et al. ..... 60/634

*Primary Examiner*—Wendell E. Burns

*Attorney, Agent, or Firm*—Barnes, Kisselle, Raisch, Choate, Whittemore & Hulbert

[57] ABSTRACT

An operator in which a plurality of explosive propellant cartridges are received in individual chambers and may be rapidly fired one at a time in sequence. The cartridges are fired by an electric current sequentially directed to the cartridges by a distributor. The gas produced by the firing of each cartridge is admitted through control valving to a common receiver. The gas in the common receiver may act on a piston to actuate a device or it may be conveyed by a conduit to a device to actuate it.

23 Claims, 33 Drawing Figures

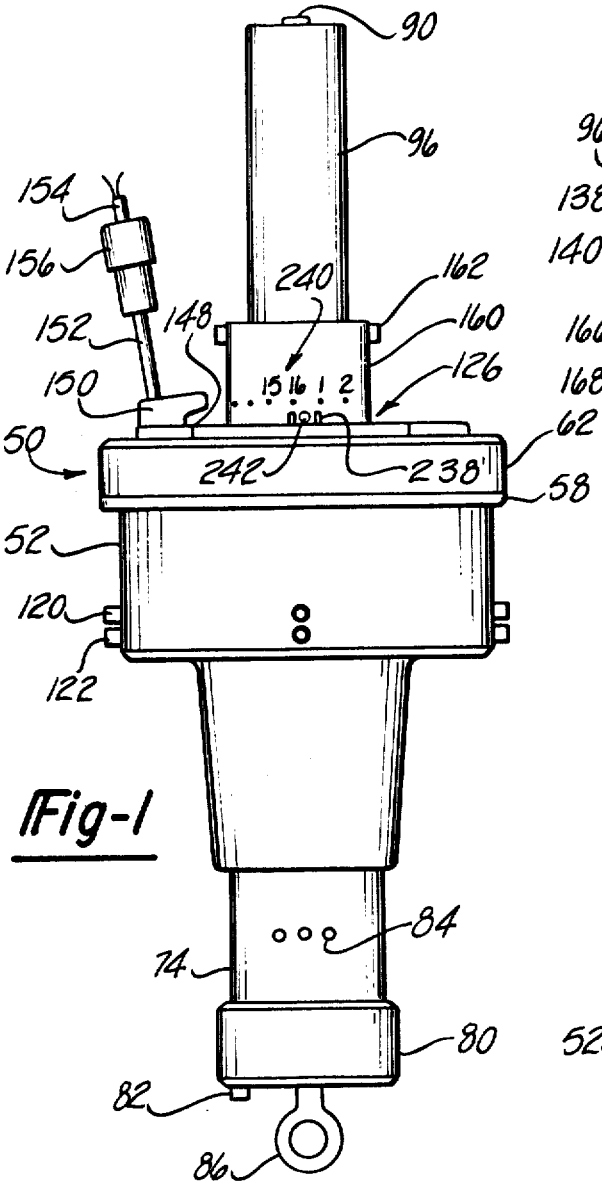
Fig-1
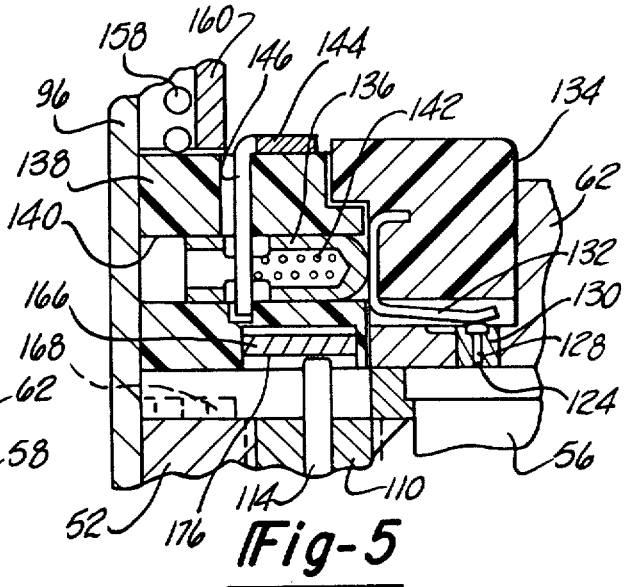
Fig-5
Fig-6
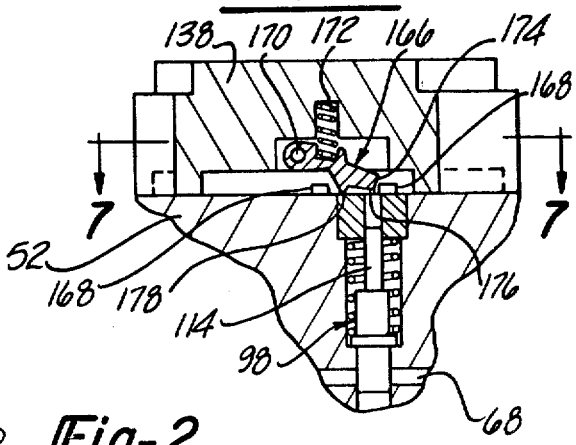
Fig-2
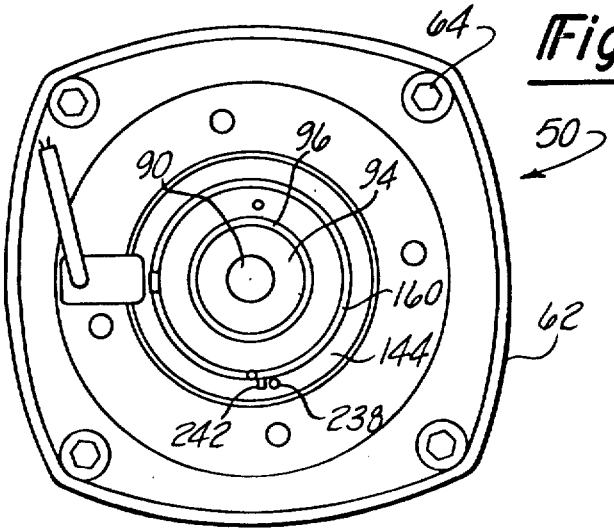
Fig-7
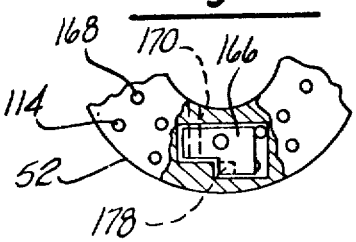

PROPELLANT OPERATOR

This invention relates to a propellant operator and, more particularly, to an operator utilizing the gas produced by firing explosive propellant cartridges to repeatedly actuate devices such as electric power switches, fluid control valves, brake systems, emergency releases and warning devices, internal combustion engines, turbine engines, and the like.

In the operator of this invention, a plurality of explosive propellant cartridges are received in individual chambers and may be rapidly fired in sequence. Preferably, the cartridges are fired by an electric current and the operator has an electric ignition system with a distributor driven by a spring motor. The gas produced by the firing of each cartridge is admitted through control valving to a common receiving chamber. The gas in the receiving chamber can act on a piston connected by a rod to the device to be actuated. Alternatively, the receiving chamber can be connected by a conduit to the cylinders of a device such as an internal combustion engine so that the gas actuates or starts the engine.

Objects, features, and advantages of this invention are to provide a propellant operator which can be rapidly repetitively cycled, is insensitive to extreme variations in temperature and adverse environmental conditions, requires no lubrication, permits use of cartridges containing differing amounts of powder, has a minimum number of moving parts, is of economic manufacture and assembly, highly reliable in operation, and may be readily and easily serviced and reloaded with cartridges.

These and other objects, features, and advantages will be apparent from the following detailed description, appended claims, and accompanying drawings in which:

FIG. 1 is a side view of a propellant operator embodying this invention.

FIG. 2 is a top view of the propellant operator of FIG. 1.

FIG. 5 is an enlarged fragmentary sectional view illustrating a portion of the distributor of the propellant operator of FIG. 1.

FIG. 6 is a fragmentary sectional view taken generally on line 6—6 of FIG. 4.

FIG. 7 is a fragmentary sectional view taken generally on line 7—7 of FIG. 6.

Figure 12:
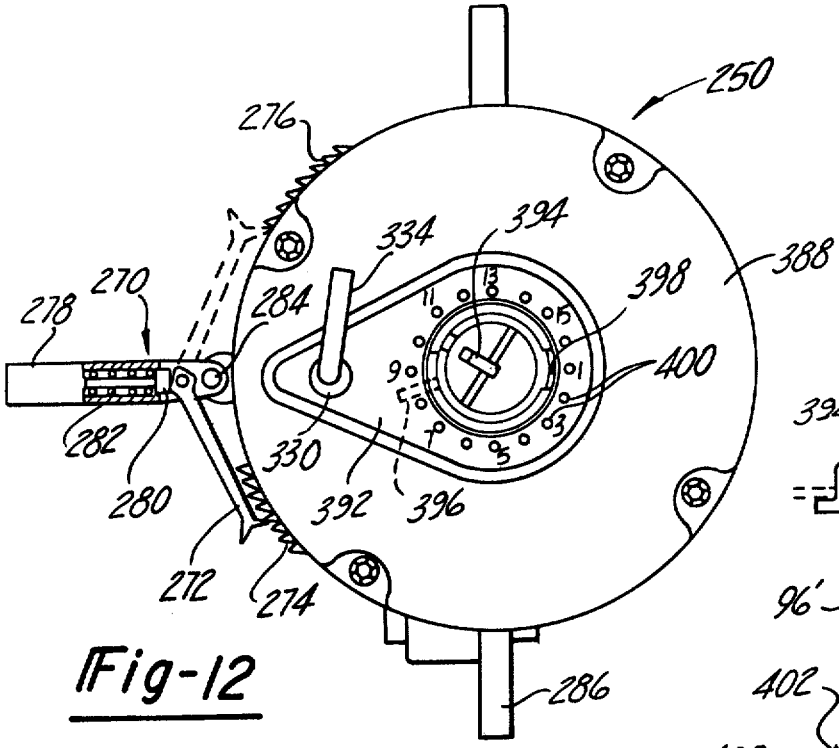
FIG. 12 is a plan view of a modified operator embodying this invention.
Figure 21:
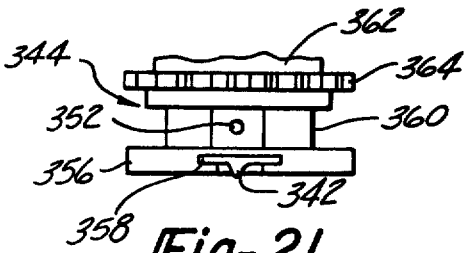
Figure 19:
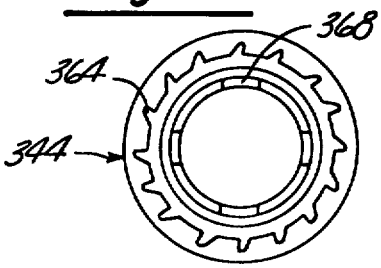
Figure 20:
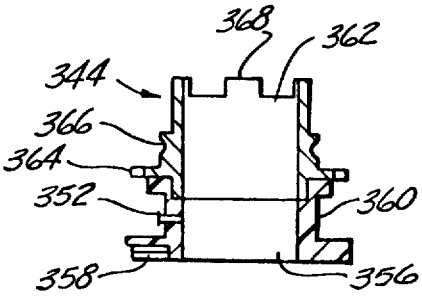

FIGS. 19, 20, and 21 are plan, full sectional, and fragmentary side views respectively of a distributor rotor of the operator of FIG. 12.

Figure 22:
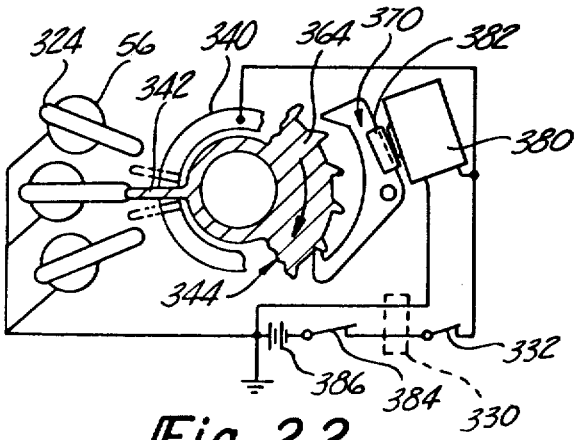

FIG. 22 is a semi-schematic diagram of the distributor assembly of the operator of FIG. 12.

Figure 23:
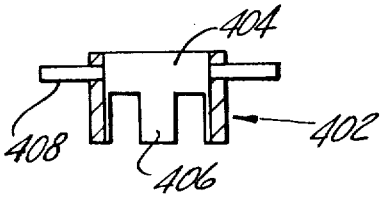
Figure 24:
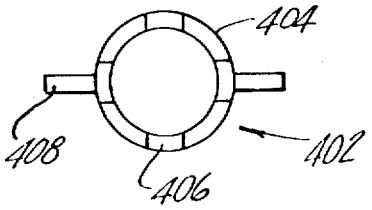

FIGS. 23 and 24 are full sectional and bottom views respectively of a tool for winding up the drive spring of the distributor assembly of the operator of FIG. 12.

Figure 25:
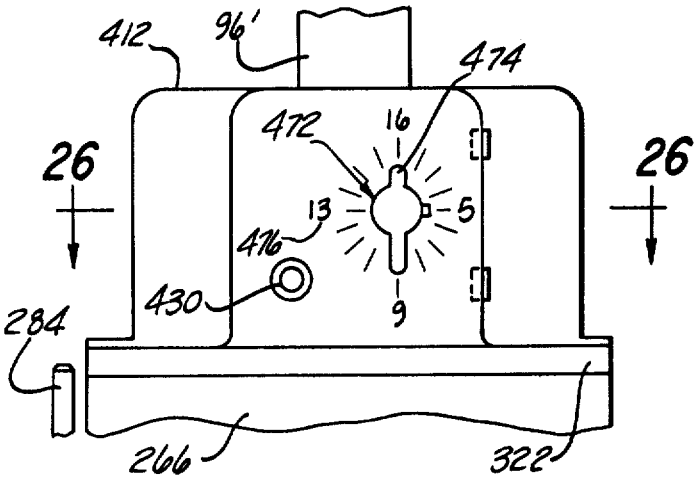

FIG. 25 is a fragmentary side view of a modified distributor assembly and cover for the operator of FIG. 12.

Figure 26:
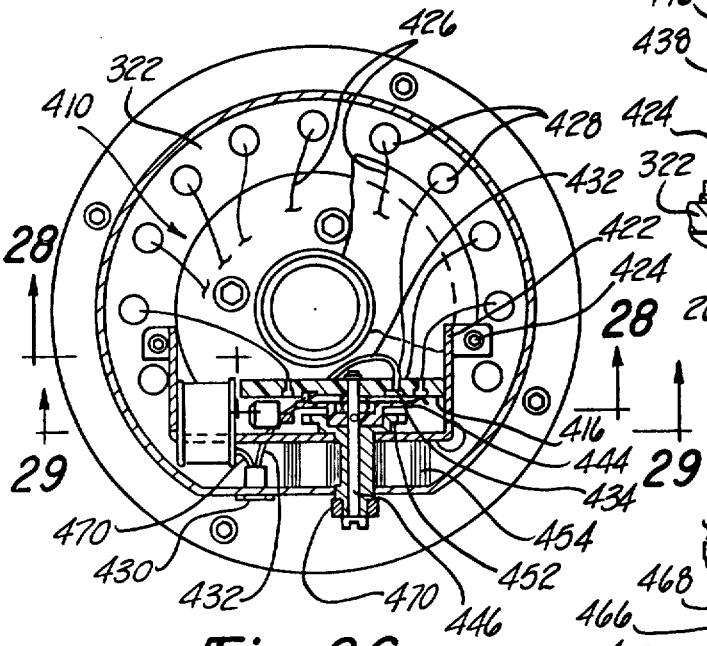

FIG. 26 is a sectional view taken generally on line 26—26 of FIG. 25.

Figure 27:
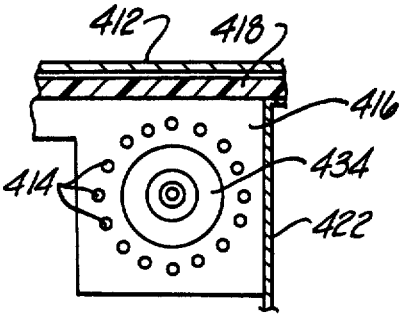

FIG. 27 is a fragmentary side view of the fixed contacts of the distributor assembly of FIG. 25.

Figure 28:
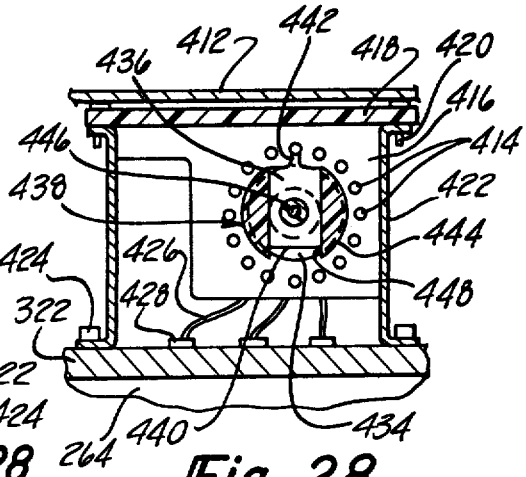
Figure 29:
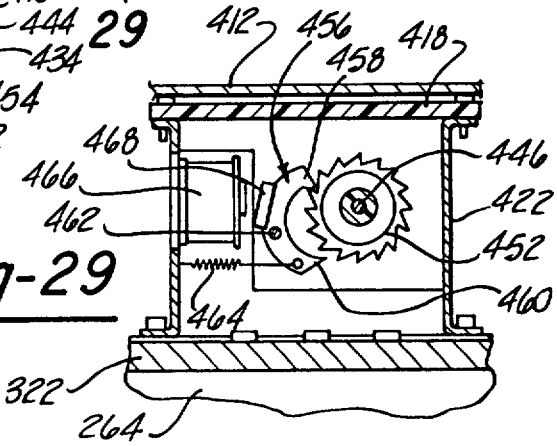

FIGS. 28 and 29 are fragmentary sectional views taken generally on lines 28—28 and 29—29 respectively on FIG. 26.

Figure 30:
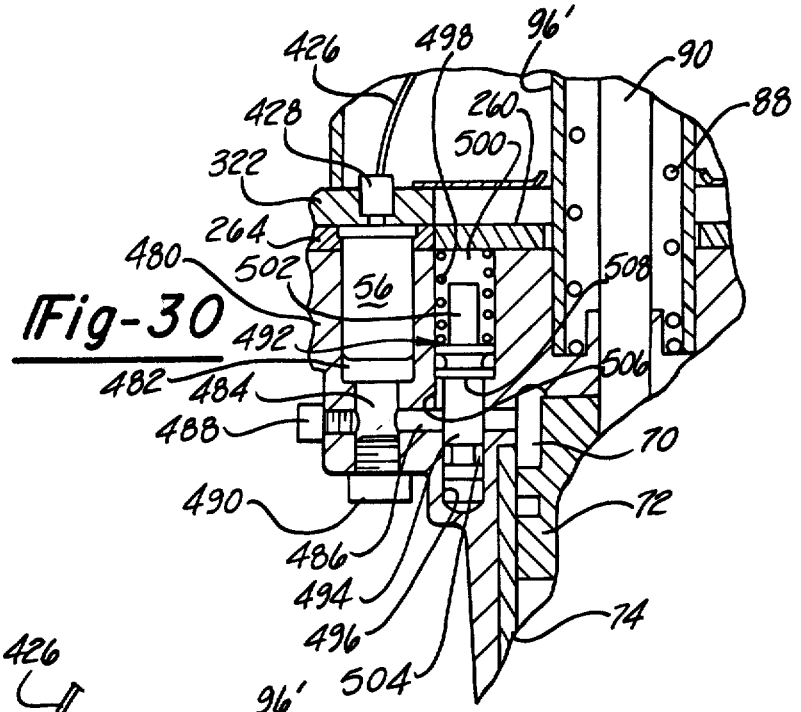

FIG. 30 is a fragmentary sectional view of a modified cartridge chamber and control valve of an operator embodying this invention.

Figure 31:
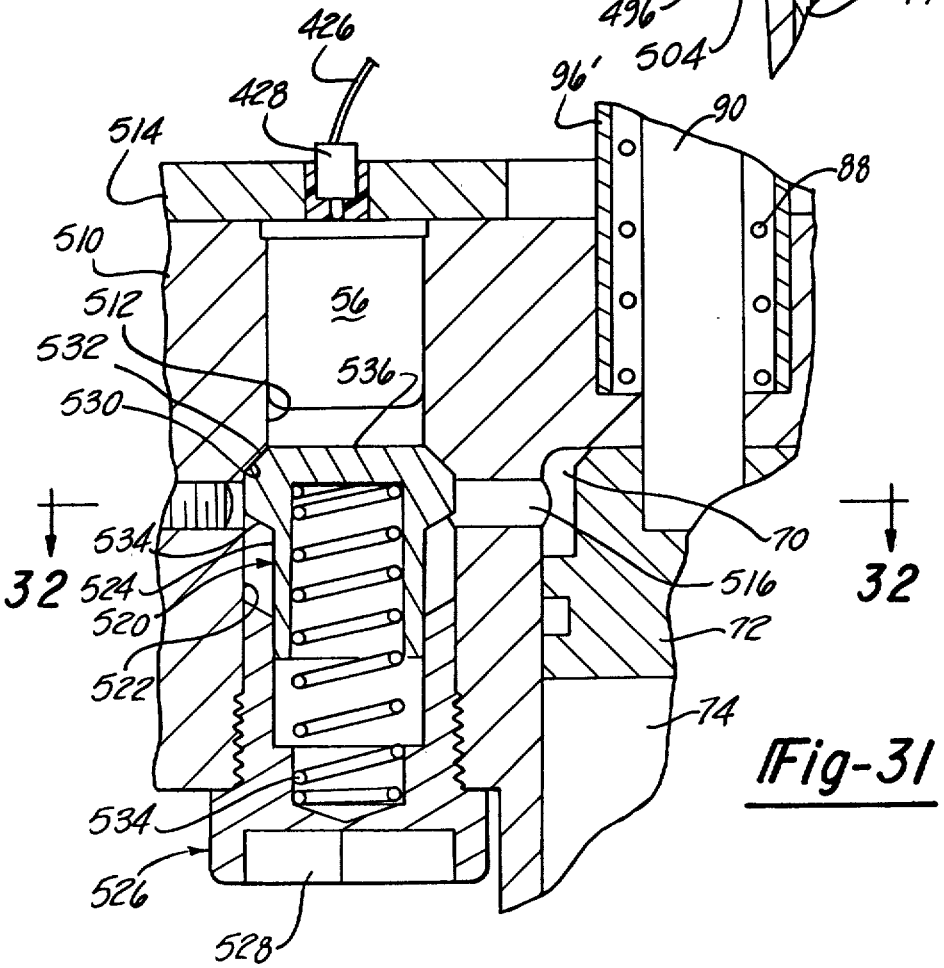

FIG. 31 is a fragmentary sectional view of another modified cartridge chamber and control valve of an operator embodying this invention.

Figure 32:
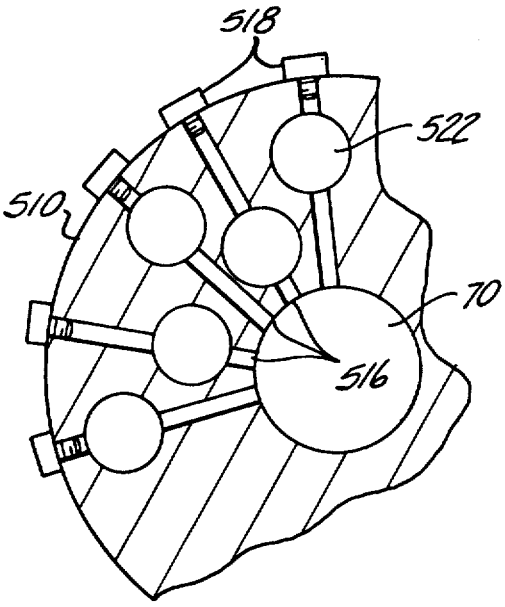

FIG. 32 is a fragmentary sectional view taken generally on line 32—32 of FIG. 31.

Figure 33:
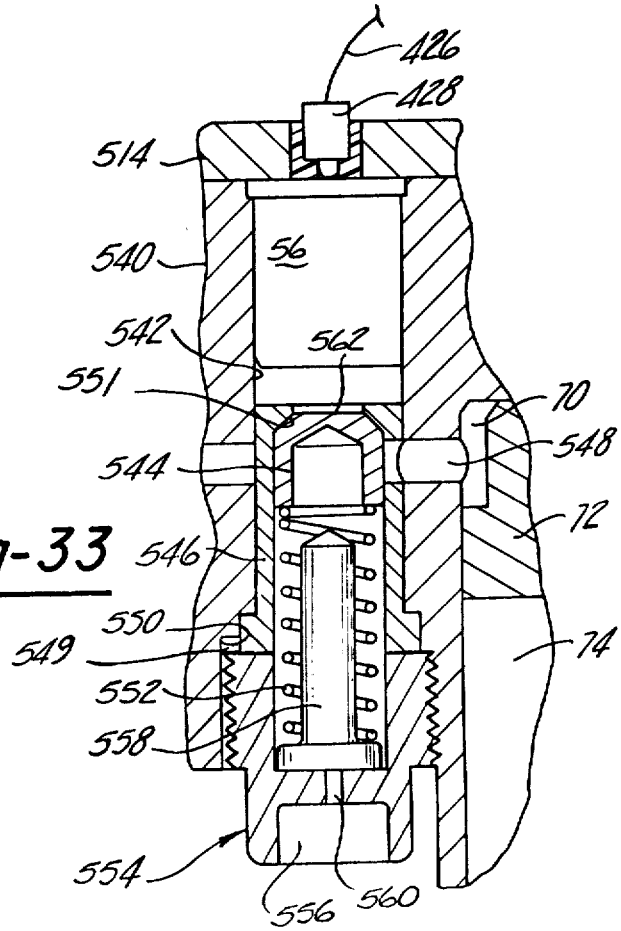

FIG. 33 is a fragmentary sectional view of a further modified cartridge chamber and control valve of an operator embodying this invention.

Referring in more detail to the drawings, FIG. 1–4 illustrate a propellant operator 50 having a main body 52 with sixteen circumferentially spaced chambers 54, each with an explosive cartridge 56 received therein. To facilitate inserting and removing cartridges from the chambers, they are received in a holder plate 58 having sixteen bores therethrough, each coaxial with one of the chambers and having a counterbore forming a recess 60 to engage the rim of the cartridge. Chambers 54 are closed by a breech or closure ring 62 overlying holder 58 and removably secured to the body 52 by cap screws 64.

The gas produced by firing a cartridge in a chamber 54 flows through passages 66 and 68 to a common receiving chamber 70 to act on a piston 72 slidably received in a cylinder 74 threaded at one end into body 52. When the piston 72 is forced by the gas to the other end of the cylinder, it is cushioned by a plurality of ring springs 76 received in a counterbore 78 in the cylinder and retained therein by a cap 80 threaded on the cylinder and prevented from unscrewing by a cap screw 82. Ring springs 76 dissipate energy by deformation and frictional engagement thereby producing a short dwell of the piston 72 and reducing the force tending to rebound the piston. As piston 72 approaches its bottommost position, the gas in cylinder 74 begins to escape to the atmosphere through bleed ports 84. The rate at which the gas escapes to the atmosphere can be controlled by the number and size of the ports 84 or a throttle valve (not shown) placed in communication with the bleed ports.

Piston 72 can actuate the device to be operated through a connecting rod 86 secured to the piston. The piston is yieldably urged toward the upper end of cylinder 74 by a compression spring 88 surrounding a rod 90 slidably received in a bore 92 in the body and secured at one end to the piston 72. One end of the spring 88 bears on the body 52 and the other end on a bushing 94 secured to the other end of rod 90 for movement therewith. The spring 90 and bushing 94 are received in a tube 96 which is threaded at its lower end into the body 52.

The communication of each chamber 54 with the common receiver 70 is controlled by a valve 98 with a shank 100 slidably received in a blind bore 102 extending completely across and perpendicular to passage 68. Each valve 98 is yieldably biased to its closed position (shown at the left in FIG. 3) by a compression spring 104 received in a counterbore 106 in the body. The spring 104 is compressed between a flange 108 on the valve 98 and a bushing 110 threaded at 112 into the body. A valve stem 114 extends through the spring 104 and is slidably received in the bushing 110.

When a cartridge 56 is fired in a chamber 54, its associated valve 98 is forced open by the evolving gas flowing through a passage 116 and acting on a piston face 118 on the valve 98 to displace it upwardly against the bias of the spring 104 to the open position (shown at the right in FIG. 3) so that the associated passage 68 communicates with the receiving chamber 70 to permit the evolving gas to actuate the piston 72. Passages 68 and 116 may be formed by drilling holes through the side of the body 52, and closing the outer ends of the holes with threaded plugs 120 and 122. When the piston becomes fully extended and the evolved gases bleed to the atmosphere through ports 84, the pressure of the gases acting on piston face 118 of the open valve 98 decreases sufficiently so that the bias of spring 104 closes the valve. In operation, all valves 98 remain closed except for the valve associated with the particular chamber 54 in which a cartridge 56 is being fired and, hence, the evolving hot gases from the fired chamber cannot enter other chambers 54 where they might ignite other cartridges.

As thus far described, operator 50 can utilize cartridges having either a percussion or electric actuated primer device for igniting their explosive propellant charges of gun powder. However, preferably, operator 50 utilizes cartridges with electric primers. Thus, cartridges 56 have electric primers with an insulated electric contact 124 in the center of the rim of each cartridge and the cartridge itself providing the other contact through which an electric current is supplied to the primer to ignite the charge. Preferably, the firing of the cartridges does not produce any particulate matter which might accumulate in and thereby restrict and plug the passages 66, 68 and 118. This is achieved by retaining the gun powder in each cartridge with wads which are made from a combustible material such as nitrocellulose which completely burns up and produces no ashes or other particulate matter when the cartridge is fired.

Figure 3:
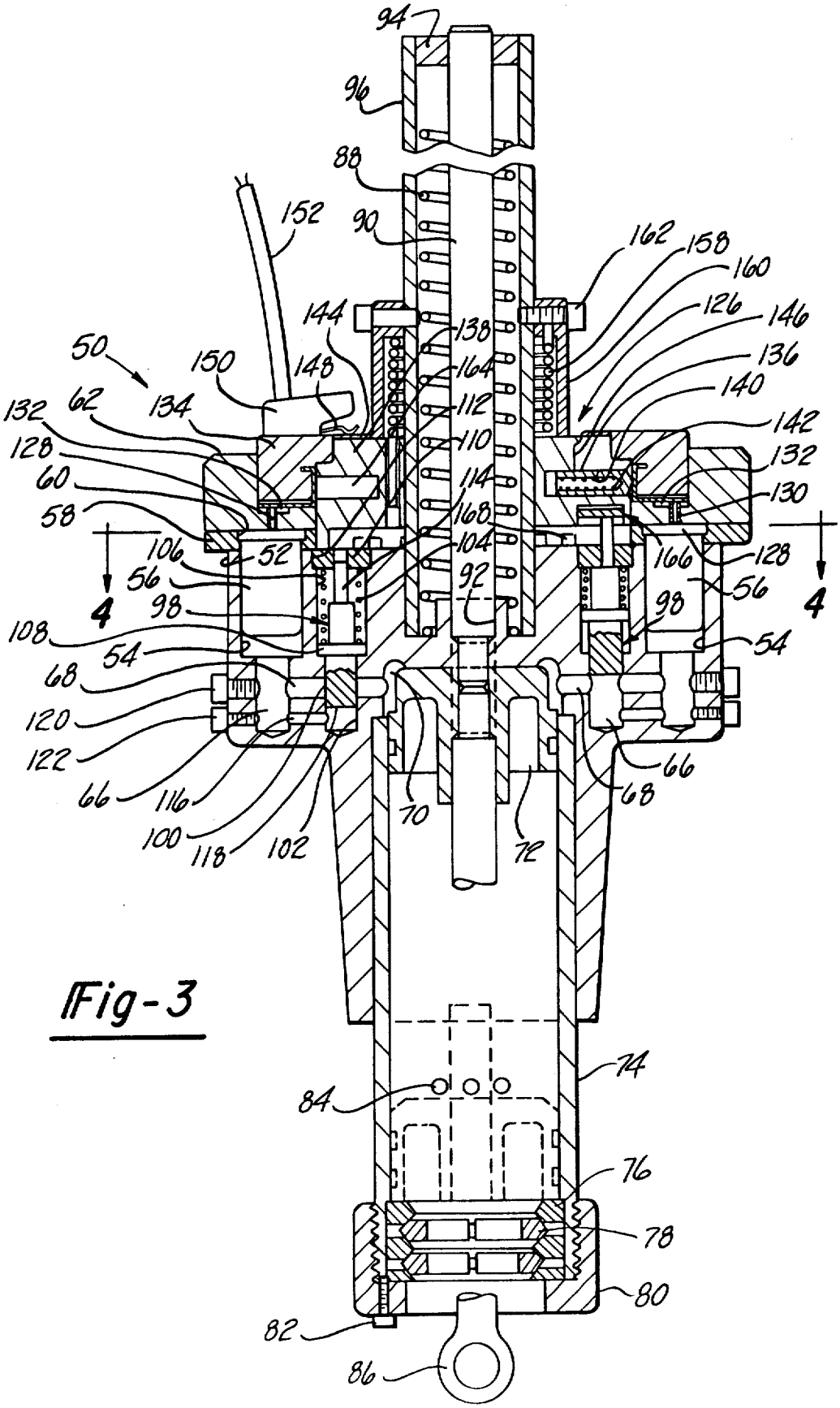
FIG. 3 is an enlarged full sectional view of the propellant operator of FIG. 1.
Figure 4:
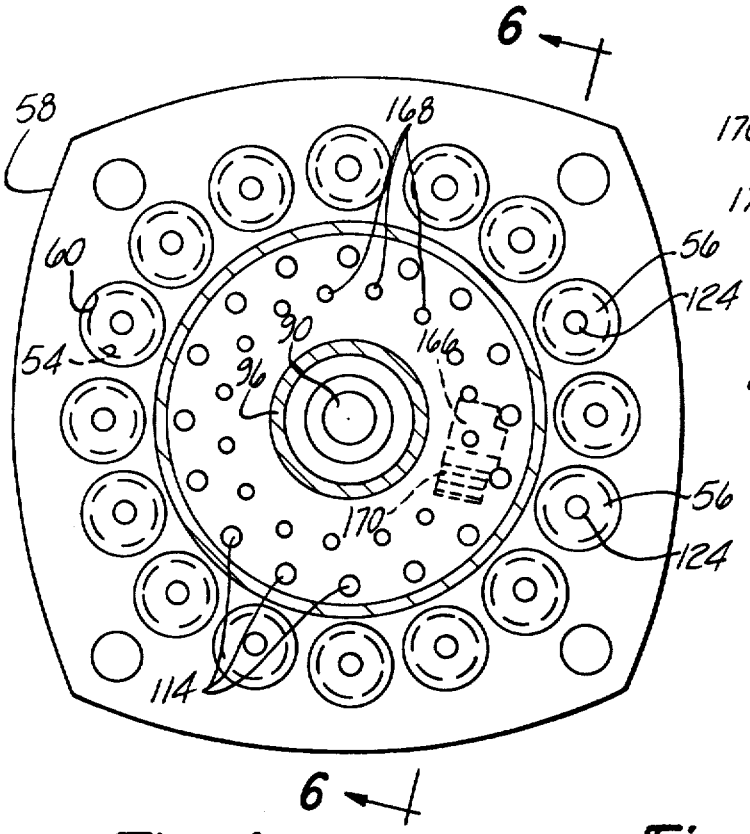
FIG. 4 is a sectional view on line 4—4 of FIG. 3.

In operator 50, an electric ignition system with a distributor assembly 126 supplies an electric current sequentially to each cartridge. As shown in FIGS. 3 and 5, a contact pin 128 is associated with each chamber 54 and mounted by an insulated sleeve 130 in the closure ring 62 so that its lower end bears on the contact 124 of the primer of the cartridge 56 received in the chamber. A plurality of fixed L-shaped contacts 132, each associated with one pin 128 are carried in circumferentially equally spaced relationship by a distributor ring 134 of an insulating material secured to the cover ring 62. Each contact 132 has a resilient leg yieldably biased into continuous engagement with the head of an associated contact pin 128.

The other legs of the contacts 132 are engaged one at a time by a contact plunger 136 (FIG. 5) carried by a rotor disc 138 of an insulating material (FIG. 5) journaled for rotation on tube 96. Plunger 136 is slidably received in a bore 140 in the disc 138 and is urged radially outward for engagement with successive contacts 132 by a compression spring 142. An electric current is supplied to the plunger 136 through a continuous ring 144 mounted on the upper face of the disc 138 and having a depending finger 146 extending into an elongate slot in the plunger with one end of spring 142 bearing thereon. An electric current is supplied to the contact ring 144 through a wiper arm 148 yieldably biased into continuous engagement with the ring and carried by an insulating block 150 secured to the ring 134.

The wiper arm 148 is electrically connected to a source of preferably direct current such as a battery (not shown) by cables 152 and 154 coupled together by an electric connector 156. The cables 152 and 154, wiper arm 148, contact ring 144, spring 142, plunger 136, fixed contacts 132, and pins 128 are all made of an electrically conductive metal such as copper and the block 150, rotor disc 138, distributor ring 134, and bushings 130 are all made of an electrically insulating material such as bakelite.

Rotor disc 138 is biased to rotate counterclockwise by a spring 158 received in a housing 160 secured by cap screws 126 to the tube 96. One end of the spring 158 is received in a hole in the disc 138 and the other end of the spring is anchored in the housing 160. When ring 62 is removed, spring 158 may be wound up by manually inserting a pin in a hole 164 in the disc 138 to provide a handle for rotating the disc clockwise.

Figure 8:
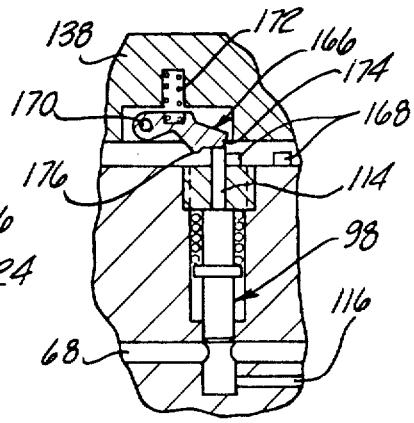
FIGS. 8 and 9 are fragmentary sectional views similar to FIG. 6, illustrating the cycling of the distributor of the propellant operator of FIG. 1.
Figure 9:
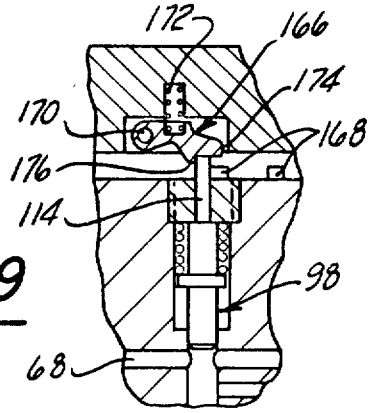

The counterclockwise indexing of rotor disc 138 to sequentially engage the contact plunger 138 with fixed contacts 132 is controlled by the cooperation of a pawl 166 with pins 168 and valve stems 114. As shown in FIG. 6, pawl 166 is pivotally mounted by a pin 170 in a pocket in rotor disc 138 and yieldably biased by a spring 172 into engagement with the upper face of body 52. Pawl 166 has an end face 174 which releasably abuts with pins 168 one at a time. Pins 168 are carried by body 52 in equally circumferentially spaced apart relationship so that when the end face 174 of the pawl 166 abuts against a pin 168 (FIG. 6), plunger 136 engages and makes electrical contact with the fixed contact 132 associated with one cartridge chamber 54 (FIG. 5). When a cartridge 56 in this chamber is fired, the evolving gases actuate its associated valve 98, the stem 114 of which engages the bottom face 176 of the pawl 166 and pivots it upwardly so that it clears the pin 168 (FIG. 8). This permits the spring 158 to rotate the disc 138 counterclockwise until a finger 178 depending from the pawl engages stem 114 of the upper end portion of valve (FIG. 9). This positions the plunger 136 of the distributor so that it lies between and is disengaged from two successive fixed contacts 132. As shown in FIG. 7, finger 178 is disposed radially outward of pins 168 and in radial and circumferential alignment with the valve stems 114.

When the evolving gases actuate the piston 72 and escape to the atmosphere through bleed ports 84, valve 98 returns to its closed position, thereby disengaging its stem 114 from finger 118 on the pawl 166. This permits the spring 158 to index the distributor disc 138 counterclockwise until the end face 174 of the downwardly pivotal pawl abuts with the next successive pin 168. This indexes plunger 136 into engagement with the fixed contact 132 associated with the next successive chamber 54 to be fired.

Figure 10:
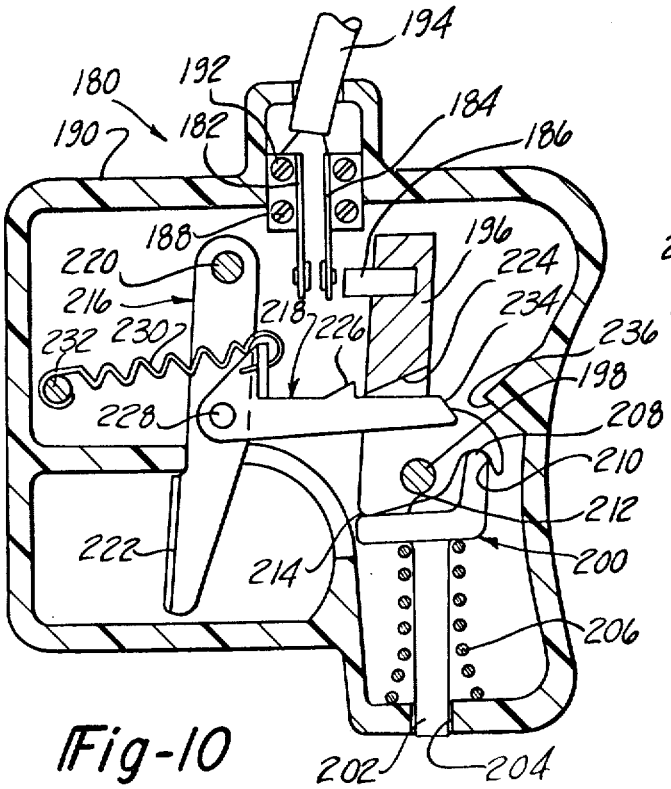
FIG. 10 is a full sectional view of an electric trigger switch for the propellant operator of FIG. 1.

The supplying of current to the distributor 126 is controlled by a trigger switch 180 shown in FIG. 10. Trigger switch 180 can be located on the operator 50 or preferably at a remote location for convenient manual operation. The trigger switch has a pair of contacts 182 and 184 in the normally open state which are momentarily closed when struck by a hammer 186 to supply a pulse of current of short duration to the operator 50. The duration of the pulse of current is long enough to activate the primer 124 of one of the cartridges 56, but short enough to terminate before the valve 98 associated with the chamber in which the cartridge is fired, closes after having been opened by the pressure of the evolving gases. This prevents the pulse of current from firing more than one cartridge.

Contacts 182 and 184 are mounted by screws 188 in a housing 190 and connected by screws 192 to an electric cable 194 to control the supply of current to the operator 50. The hammer 186 is a pin of an insulating material mounted adjacent one end of an arm 196 pivotally mounted adjacent its other end in the housing at 198.

Figure 11:
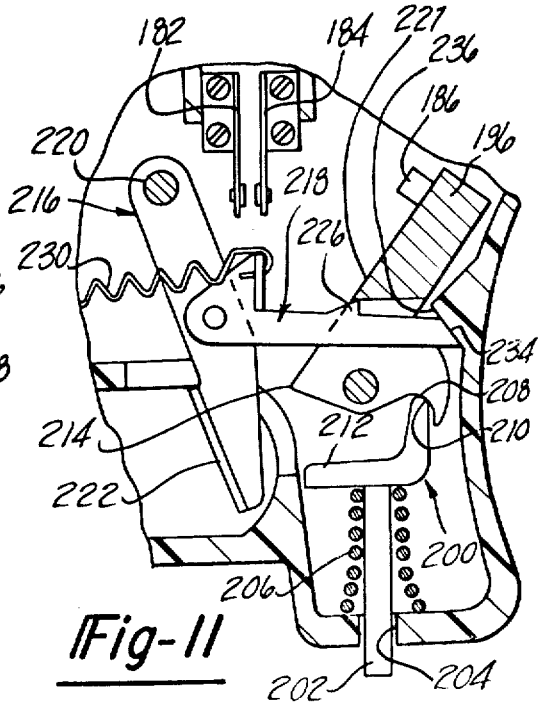
FIG. 11 is a fragmentary sectional view of the trigger switch of FIG. 10 with its hammer shown as it is being released for firing.

Hammer arm 196 is yieldably biased by an L-shaped actuator 200 at the upper end of a stem 202 slidably received in a hole 204 in the housing 190 and yieldably urged upwardly into engagement with the lower end of the arm by a spring 206. The arm 196 is normally yieldably retained in the position shown in FIG. 10, wherein hammer 186 is slightly spaced from contact 184, by engatement of the upper end 208 of one leg of actuator arm 200 with the hook portion 210 of hammer arm 196 and the engagement of the other leg 212 of actuator arm 208 with the heel 214 on the hammer arm 196. When the hammer arm 196 is rotated clockwise to its cocked position as shown in FIG. 11, spring 206 is compressed. When the hammer arm 196 is released from its cocked position shown in FIG. 11, spring 206 causes it to rotate counterclockwise with sufficient force so that the hammer 186 strikes contact 184. Thereafter, it is urged by spring 206 to return to its normal position shown in FIG. 10.

Manual movement of trigger 216 in cooperation with a latch lever 218, moves the hammer arm 196 from its normal position shown in FIG. 10 to its cocked position shown in FIG. 11, and releases the hammer arm so that hammer 186 can strike the contact 184. The trigger 216 is pivotally mounted at one end at 220 in the housing 190 and has a finger pad 222 on its other end arranged to be engaged by a finger to manually move the trigger. One end of the latch lever 218 extends through a slot 224 in the lower end of the hammer arm 196 and a central tang or latch 226 normally engages the abutment 227 on the hammer arm. The other end of latch lever 218 is pivotally connected at 228 to the trigger 216 and both the trigger and the latch lever are yieldably urged to their normal positions shown in FIG. 10 by a spring 230 connected at one end to the latch arm and at the other end to the housing 190 by a pin 232. As shown in FIG. 11, when the trigger 216 is manually squeezed, the latch arm 218 pivotally moves the hammer arm 196 clockwise until latch 226 disengages from the hammer arm due to a clockwise pivotal movement of the latch arm produced by the cooperation of a cam surface 234 on its end with an inclined ramp 236 on the housing 190. This disengagement releases the hammer arm 196 which is rotated counterclockwise by the spring biased actuator 200 to cause the hammer 186 to strike the contacts 184 and then return to its normal position. When the trigger 216 is manually released, it is returned by the spring 230 to the position shown in FIG. 10 where latch 226 on arm 218 again engages abutment 227 on the hammer arm 196.

The particular chamber 54 to which an electric current will be directed by the distributor assembly 126 is indicated by the cooperation of a marker pin 238 on rotor disc 138 and a series of indicia and numerals 240 equally circumferentially spaced on the periphery of the housing 160 (FIG. 1). To limit the extent to which the drive spring 158 can both be manually wound up and unwound during use of the operator 50, a positive stop pin 242 is fixed to housing 160 so that it can be engaged by the marker pin 238 carried by the rotor disc 138.

Setup and Operation Of The Operator 50

To setup operator 50 in an operative condition, its piston rod 86 is connected to a device such as a large capacity electric power switch to be actuated by the operator. Through cables 194 and 154, trigger switch 180 and the distributor 126 of the operator 50 are electrically connected to a source of power such as a battery (not shown) so that actuation of the trigger switch applies a short pulse of current to the distributor of the operator.

Connector 156 is disconnected and closure ring 62 and holder 58 are removed generally axially from body 52 of the operator. The holder 58 is loaded with cartridges 56, passed generally axially over tube 96 of the operator, and rotated so that each cartridge is inserted into one of the chambers 54 of the body. The distributor drive spring 158 is wound up by inserting a rod or other handle into hole 164 and manually turning the rotor disc 138 clockwise as viewed in FIG. 2 until the pin 238 bears against the stop pin 242. The handle is then removed, closure ring 62 is passed generally axially over tube 96, and both the closure ring and the cartridge holder 58 are firmly secured on the body 52 by inserting and tightening cap screws 64. Connector 156 is reconnected and then the operator 50 is ready to be cycled.

Cycling of the operator 50 is initiated by manually squeezing trigger 216 of switch 180 which causes the contacts 182 and 184 to momentarily close and thereby supply a short pulse of electric current to the distributor assembly 126. Since the plunger 136 carried by the rotor disc 138 of the distributor engages one of the fixed contacts 132, the electric current is conducted to the primer 124 of the cartridge 56 received in one of the chambers 54 (such as chamber number one) which ignites the explosive propellant charge in the cartridge. Ignition of the propellant rapidly produces a relatively large quantity of gases under high pressure which flow through passages 66 and 116 to open the associated valve 98 by acting on its face 118 (shown at the right in FIG. 3) so that the gases flow through passage 68 and into receiving chamber 70. The opening of this valve 98 also causes its stem 114 to engage and pivot upward pawl 166 so that it disengages from its associated pin 168 which permits rotor disc 138 to be rotated by the spring 158 until stop 178 on the pawl engages the valve stem. This disengages the plunger 136 from all of the contacts 132 so that no current can be supplied to any cartridge until the valve 98 closes even if switch 180 is actuated again.

The high pressure gases entering chamber 70 rapidly move piston 72 against the bias of spring 88 to the lower end of its cylinder 74 thereby imparting with great force, a rapid actuating movement to the device connected to piston rod 86. As piston 72 approaches the lower end of the cylinder 74, its movement is cushioned by ring springs 76, and as the piston becomes fully extended, the gases under high pressure bleed to the atmosphere through ports 84. Bleeding the gases to the atmosphere eventually decreases the pressure within cylinder 74 sufficiently to enable spring 88 to return piston 72, and the spring 184 to close the valve 98 associated with the chamber 54 in which the cartridge was fired. Closing this valve 98 permits the rotor disc 138 of the distributor 126 to be advanced so that plunger 136 engages the contact 132 for the next chamber 54 to provide a conductive path for igniting the primer 124 of the cartridge 56 in this next chamber. This is achieved by the stem 114 of this valve retracting from engagement with pawl 166 (FIG. 6) which permits the pawl to pivot downwardly so that it will engage the next pin 168, thereby stopping rotation of disc 138 when plunger 136 bears on the contact 132 associated with the next chamber. Upon completion of this indexing movement by the distributor 126, the operator 50 is ready to begin another cycle which is initiated by again manually squeezing the trigger 216 of the switch 180.

The Modified Operator 250

FIGS. 12 through 22 illustrate a modified operator 250 in which, unlike operator 50, if a cartridge 56 fails to fire, the remaining cartridges can still be rapidly sequentially fired to actuate a device connected to the operator. As shown in FIGS. 12–15, operator 250 has a main body 252 with sixteen equally circumferentially spaced chambers 254, each with a propellant cartridge 56 received therein. The cartridges are received in two semicircular holder rings 256 (FIG. 17), each having eight bores therethrough coaxial with the chambers and recesses 60, which engage the rim of the cartridges. Locating the holder rings 256 on the upper face of the body 252 is facilitiated by ears 258 (FIG. 17) circumferentially spaced on the rings to overly corresponding lugs 260 on the body and by a valve retainer ring 262 secured to the body by cap screws 264.

After locating rings 254 on the body, the cartridges 56 can be readily inserted into the chambers. To provide convenient handles for removing the rings 256 and the cartridges therein from the body, the ears 258 are wider than the lugs 260.

Holders 256 are releasably secured to the body 252 and the upper end of each chamber 254 is closed by a breech ring 266 having circumferentially spaced and radially inwardly extending dogs 268 designed to be releasably locked with lugs 260 on the body 252 by rotation of the breech ring relative to the body.

Preferably, the engaging surfaces of lugs 260 and dogs 268 are correspondingly tapered so that the breech ring 266 is locked to the body when rotated counterclockwise (as viewed in FIG. 12) and released for removal when rotated clockwise. Locking rotation of the breech ring 266 is facilitated by a ratchet assembly 270 having a pawl 272 engagable with circumferentially spaced sets of teeth 274 and 276 on the breech ring. Pawl 272 is pivotally mounted on a handle 278 and yieldably biased into engagement with the teeth by a plunger 280 and a spring 282 received in a bore in the handle. Handle 278 is slidably received on a pivot pin 284 fixed to the body 252. The ratchet assembly can be used to unlock and release the breech ring 266 by removing it from pivot pin 284, moving the lever arm 272 to the other side of the handle, and slipping it back on the pin to place the lever arm in the position shown in phantom in FIG. 12.

Breech ring 266 is releasably retained in its locked position by engagement of a handle pin 286 with a latch 288 (FIGS. 13 and 14) pivotally mounted by pin 290 on body 252 and yieldably urged to its engaged position by a spring 292.

The gases produced by firing a cartridge 56 in a chamber 254 flow through passages 294 and 296 and into the common receiving chamber 70 to act on the piston 72 slidably received in the cylinder 74. When the piston 72 is forced by the gases to the lower end of the cylinder, its movement is cushioned by a plurality of ring springs 76 received in a counterbore 78 of the cylinder and retained therein by a cap 80. As the piston becomes fully extended, the gases in the cylinder 74 escape to the atmosphere through bleed holes 84. The piston 72 is connected to a device to be actuated by the connecting rod 86 and is urged to the upper end of the cylinder by a compression spring 88 surrounding the rod 90 received in a tube 96'. The outer end of each passage 294 and 296 is sealed by a plug 298 and 300 threaded into the end of each passage. If desired, the rate of flow of gases through each passage can be controlled by a restrictor 302 (FIG. 18) inserted in the passage in lieu of plug 300.

Figure 15:
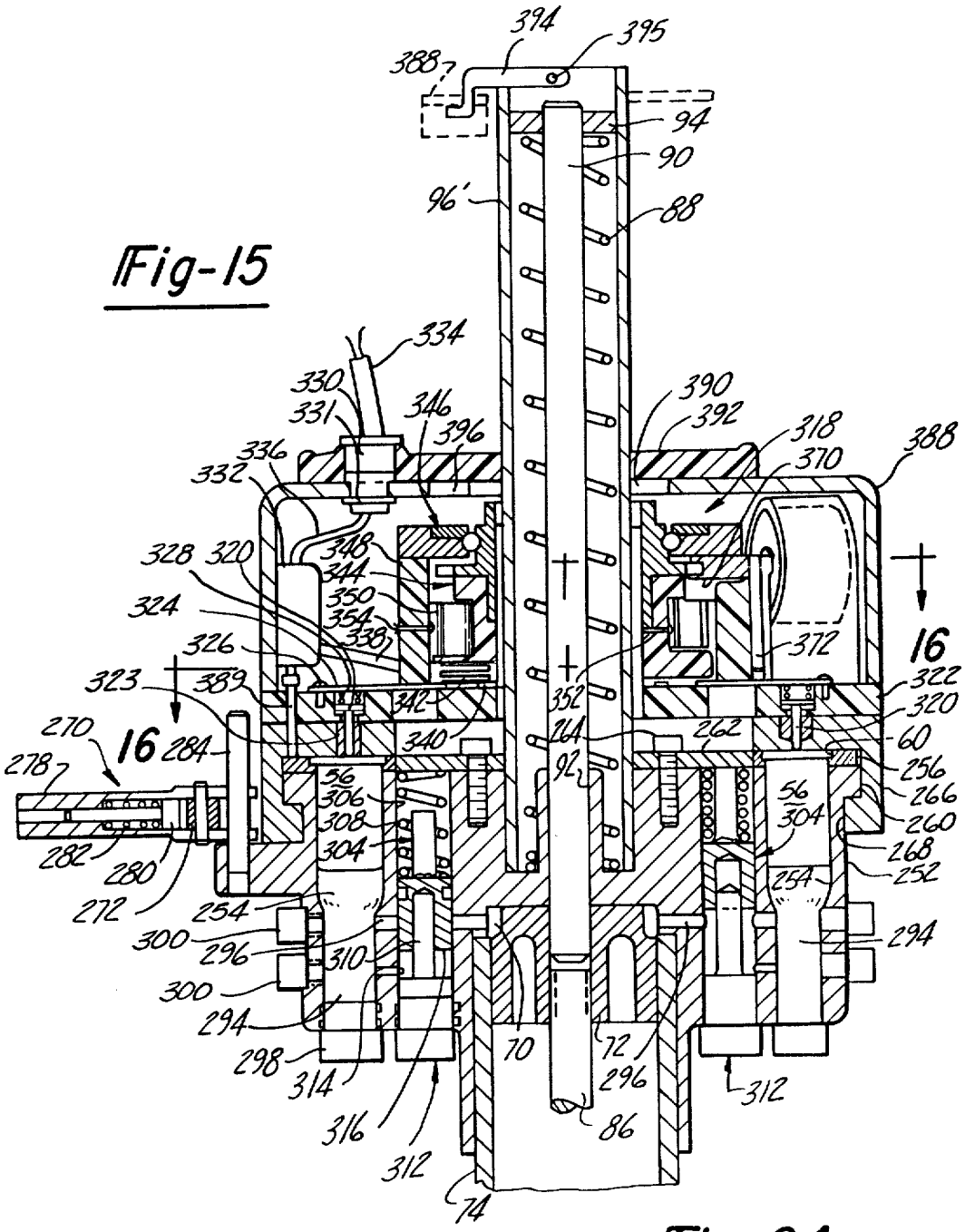
FIG. 15 is an enlarged fragmentary full sectional view of the operator of FIG. 12.

As shown in FIG. 15, the communication of each chamber 254 with the common receiver 70 is controlled by an associated valve 304 slidably received in a bore 306 extending completely through and perpendicular to passage 296. Each valve 304 is yieldably biased to its normally closed position (shown at the left in FIG. 15) by a spring 308 and is slidably received over a guide pin 310 integral with a plug 312 threaded into the bottom of the bore 306.

When a cartridge 56 if fired in a chamber 54, its associated valve 304 is forced open (as shown at the right in FIG. 15) against the bias of the spring 308 by the evolving gases flowing through passage 314 and acting on a lower face 316 of the valve, thereby permitting the gases to flow through passage 296 and into receiving chamber 70 to actuate piston 72. As the piston 72 becomes fully extended, the evolving gases bleed to the atmosphere through ports 84, thereby decreasing the pressure of the gases sufficiently so that the piston returns to its starting position and the valve 304 closes. All of the valves 304 remain closed except for the valve associated with the chamber 254 in which a cartridge 56 is being fired and, hence, the evolving hot gases cannot enter the other chambers 54 where they might ignite other cartridges.

Figure 16:
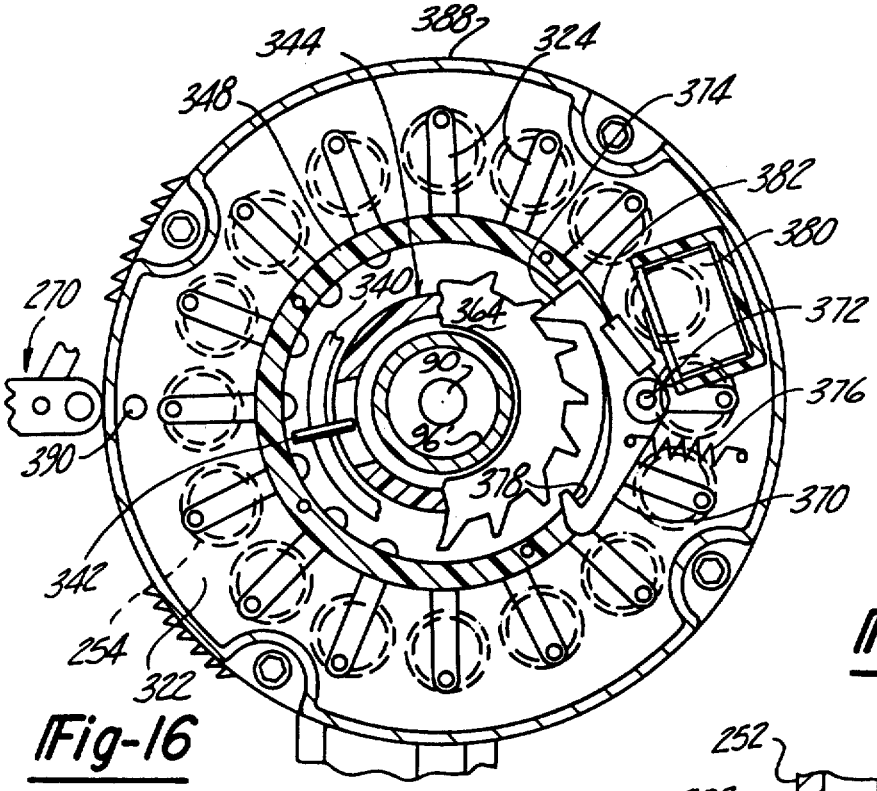
FIG. 16 is a sectional view taken on lines 16—16 on FIG. 15.
Figure 17:
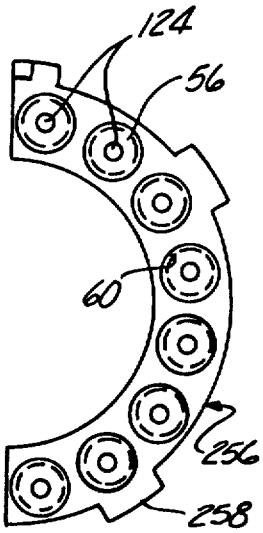
FIG. 17 is a plan view of one of the cartridge holders of the operator of FIG. 12.
Figure 18:
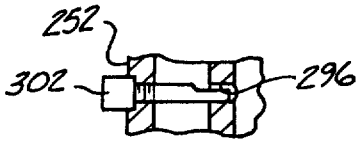
FIG. 18 is a fragmentary sectional view of a bleed valve which may be utilized in the operator of FIG. 12.

An electric current is supplied sequentially to the primer 124 of each cartridge 56 by a distributor assembly 318. As shown in FIGS. 15 and 16, a contact pin 320 associated with each chamber 254 is slidably received in a counterbore in a carrier disc 322 and a sleeve 323 in the closure ring 266 so that its lower end bears on the contact 124 of the primer of the cartridge 56 received in such chamber. A plurality of fixed contacts 324 each associated with one pin 320, are secured by screws 326 on the upper face of the carrier disc 322 in equally circumferentially spaced apart and generally radially extending relationship. Each fixed contact 324 is continuously electrically connected with its associated contact pin 320 by a spring 328 which also yieldably urges the pin into engagement with the primer contact 124 of the cartridge. An electric current is supplied through a plug 330, receptacle 331, safety switch 332, and interconnecting electric cables 334, 336, and 338 to a continuous ring 340 disposed radially inward of the fixed contacts 324 and secured to the upper face of the carrier disc 322.

The fixed contacts 324 are electrically connected one at a time with contact ring 340 to conduct an electric current to the primer 124 of one of the cartridges by a wiper contact 342 (FIGS. 15 and 21) carried by a rotor assembly 344 journaled by a bearing assembly 346 received in a housing 348 secured to the carrier disc 322. Rotor assembly 344 is driven in a clockwise direction by a coil spring 350 secured at one end by a rivet 352 to the rotor 344 and secured at the other end by rivet 354 to the housing 348. As shown in FIGS. 19–21, rotor assembly 344 has a lower hub 356 of a plastic insulating material with a recess 358 in its lower peripheral edge in which wiper contact 342 is received in a central groove 360 in which a portion of the coil spring 350 is received. Rotor assembly 344 also has an upper hub 362 with a cogwheel 364 having sixteen cogs, a semi-circular groove 366 for receiving the balls of bearing assembly 346, and to facilitate winding of the drive spring four equally circumferentially spaced and axially projecting tabs 368. The contact ring 340, wiper contact 342, fixed contact 324, springs 328, and contact pins 320 are all made of an electrically conducive metal such as copper, and the carrier disc 322, sleeves 323, lower rotor hub 356, and housing 348 are all made of an electrically insulating material such as bakelite.

The clockwise rotation of rotor 344 to sequentially engage wiper contact 342 with the fixed contacts 324 is controlled by cooperation of cogwheel 364 with an escapement arm 370 (FIG. 16) pivotally mounted by a pin 372 in a recess in the housing 348. Rotor 344 is releasably stopped with the wiper 342 disposed between two adjacent fixed contacts 324 and disconnected from all of the fixed contacts (as shown in FIG. 16) by engagement of a tooth 374 on the escapement arm 370 with a cog of the cogwheel 364 of the rotor. Tooth 374 of the arm 370 is yieldably urged into engagement with the cogwheel by a spring 376. Rotor 344 is permitted to be advanced by spring 350 so that the wiper 342 engages one of the fixed contacts 324 and is releasably retained in such position by rocking movement of lever 370 to disengage its one tooth 374 from the cogwheel 364 and engage its other tooth 378 with one of the cogs of the cogwheel. This engagement of the wiper 342 with one of the fixed contacts 324 provides a conductive path for supplying and electric current to the primer 124 of one of the cartridges 56 received in one of the chambers 254.

The escapement arm 370 is pivotally moved to advance rotor 344 so that its wiper 342 engages one of the fixed contacts 324 by the attraction between an energized electromagnet 380 mounted on the disc 322 and an iron slug 382 fixed to the arm. As shown in FIG. 22, electromagnet 380 and contact ring 340 are electrically connected in parallel so that an electric current will simultaneously energize magnet 380 to advance rotor 344 and be conducted to the primer 124 of the cartridge 56 associated with the fixed contact 324 connected by the wiper 342 with contact ring 340. An electric current is supplied to the distributor assembly 318 through a trigger switch 384 connected to a source of direct current which is preferably a battery 386.

The distributor assembly 318 is enclosed by a cover 388 secured to disc 322. The safety switch 332 is secured to the side wall of the cover 388 and is arranged so that its yieldably biased and normally open contacts are closed when an actuator pin 389 slidably received in a hole through the disc 322 and the closure ring 266 is moved to the position shown in FIG. 15 by placing the closure ring on the body 252.

An access hole 390 in the cover 388 is closed by a removable shield 392, preferably of a transparent and elastic material, removably receivable over tube 96' and fixed to plug 330 which, when inserted in receptacle 331, releasably retains the shield on the cover. When shield 392 is removed from the cover 388 and the closure ring 266 is released from the body 252, the cover and closure ring assembly can be suspended on the upper end of tube 96' by a hook 394 (FIGS. 13 and 15) pivotally mounted on the tube by a pin 395. The cover 388 is engaged with the hook 394 by removing shield 392, pivoting the hook to its horizontal position, moving the cover upward so the hook passes through a slot 396 in the cover, and rotating the cover slightly so that it overlies the outer portion of the hook.

The particular chamber 254 to which an electric current will be directed by the distributor assembly 318 is indicated by the cooperation by a mark 398 on the top of the rotor assembly 344 and a series of circumferentially spaced indicia and numerals 400 on either the shield 392 or the cover 388.

Figure 13:
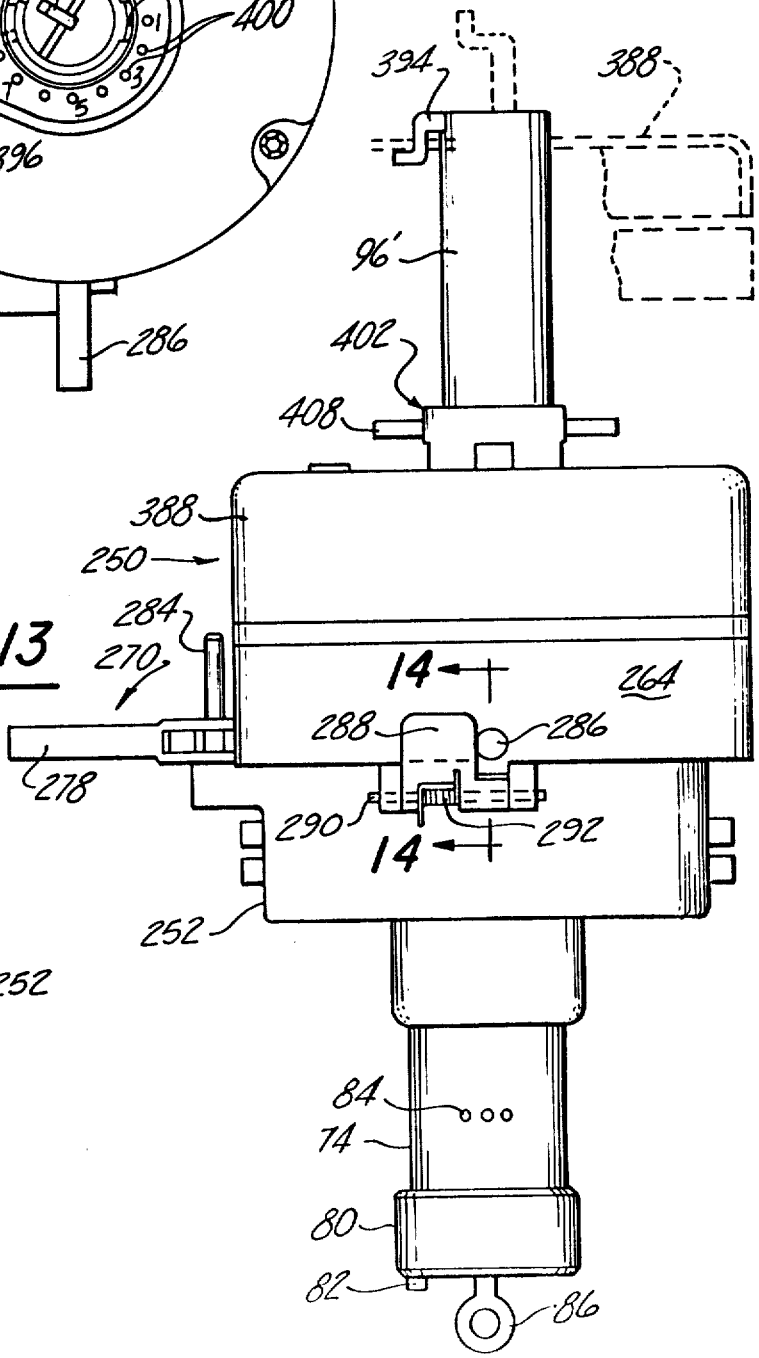
FIG. 13 is a side view of the operator of FIG. 12.
Figure 14:
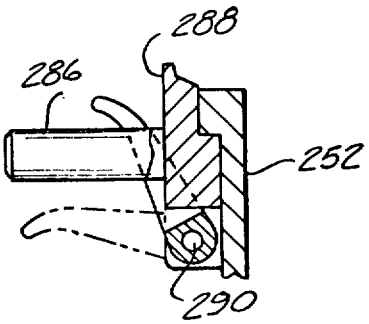
FIG. 14 is a fragmentary sectional view on line 14—14 of FIG. 13.

The drive spring 350 of the distributor may be readily wound up by using a tool 402 shown in FIGS. 23 and 24. The tool 402 has a tubular body 404 with four equally circumferentially spaced depending fingers 406 arranged for interdigital engagement with the tabs 368 on the upper end of rotor 344. A pair of radially extending handles 408 are fixed in diametrically opposed relation on the upper end of the tubular body 404. As shown in FIG. 13, the drive spring 350 for the distributor assembly 318 may be wound up with cover 388 and closure ring 266 mounted on the body 252 by removing shield 392, sliding the tool over the tube 96' and into interdigital engagement with the rotor assembly 344, and using the handles 408 to rotate the tool counterclockwise to wind up the drive spring.

Setup and Operation of the Operator 250

The operator 250 may be set in operative condition to actuate a device such as changing the state of the contacts of a large electric power switch by connecting its piston rod 86 to the device. Plug 330 is disconnected and shield 392 removed. The closure ring 266 is unlocked and released from the body 252 by moving latch 288 to its disengaged position and manipulating ratchet tool 270 to rotate the closure ring clockwise from the position shown in FIGS. 12 and 13. The released closure ring 266 and the cover 388 are then manually raised and manipulated so that they are suspended from hook 394.

The holders 256 are removed from the body 252, any spent cartridges are discarded, and live cartridges 56 are placed in the holders. The holders 256 are again placed on the body 252 with the cartridges 56 each inserted in one of the chambers 254 in the body. The cover 388 is manually disengaged from the hook 394 and along with the closure ring 266 lowered onto the body 252. Ratchet 270 is used to manually rotate the closure ring 266 counterclockwise to lock both the holders 256 and the closure ring on the body 252, and latch 288 is manipulated to secure the closure ring in its locked position.

The drive spring 350 of the distributor assembly 318 is wound up by placing tool 402 over the tube 96', engaging the tool with the rotor 344, and manually turning the tool 402 counterclockwise to wind up the spring. The tool 402 is removed from the tube 96', and shield 392 is passed over the tube and plug 330 inserted in receptacle 331. The cable 334 is connected through the trigger switch 394 to an appropriate source of preferably direct current, such as the battery 386.

A cycle of operator 250 is initiated by closing the switch 384 to energize magnet 380 and supply electric current to contact ring 340 of the distributor assembly 318. Energizing the magnet 380 pivots the escapement arm 370 against the bias of the spring 376 to disengage its tooth 374 and engage its tooth 378 with the cogwheel 364, thereby moving wiper 342 into engagement with a fixed contact 324 associated with one of the chambers 254. This directs an electric current to the primer 124 of the cartridge 56 in this chamber 254 which ignites the propellant of this cartridge. The ignited propellant rapidly evolves a relatively large quantity of gases under high pressure which flow through passages 294 and 314 to open the valve 304 associated with this chamber 254 (as shown at the right in FIG. 15), thereby permitting the evolving gases to flow through passage 296 and into receiver 70.

The high pressure gases entering receiver 70 rapidly move piston 72 against the bias of spring 88 and thereby impart a rapid actuating movement with a very substantial force to the device such as a large electric power switch connected to the piston rod 86. As the piston 72 approaches the lower end of the cylinder 74, its movement is cushioned by the spring washers 76 and as the piston becomes fully extended, the gases bleed to the atmosphere through ports 84. This decreases the pressure of the gases sufficiently to enable spring 88 to return piston 72 to the other end of the cylinder 74 and the spring 308 to close the valve 304 associated with the chamber 254 in which the cartridge 56 was fired.

When trigger switch 384 is opened, the electric current is no longer supplied to the distributor assembly 318 and electromagnet 380 is de-energized. When magnet 380 is de-energized, escapement arm 370 is locked by spring 376 to disengage its tooth 378 and engage its tooth 374 with the cogwheel 364, thereby advancing wiper 342 so that it lies between two adjacent fixed contacts 324 and is disengaged from all of the fixed contacts. Upon disengagement of the wiper 342 from all of the fixed contacts 342, the operator 250 is ready to begin another cycle which is initiated by closing trigger switch 384.

With the distributor assembly 318 and the valve 304 arrangement of operator 250, even if one of the cartridges 56 fails to fire, the remaining cartridges can be rapidly fired in succession. Moreover, in operator 250, if needed, a plurality of cartridges 56 may be fired in rapid succession in order to produce sufficient force to move piston 72 to its fully extended position.

The Modified Distributor Assembly 410

FIGS. 25 to 29 illustrate a modified distributor assembly 410 and a cover 412 which may be used with operator 250 in lieu of the distributor assembly 318 and the cover 388. As shown in FIGS. 26 and 27, distributor assembly 410 has a plurality of equally circumferentially spaced fixed contacts 414 embedded in a carrier plate 416 of insulating material having a transverse top portion 418 secured by screws 420 to a sheet metal bracket 422 attached by cap screws 424 to the carrier disc 322. Each fixed contact 414 is electrically connected by a cable 426 and a connector 428 to one of the pins 320 contacting the primer 124 of a cartridge 56 received in one of the chambers 254. An electric current is supplied through a receptacle 430 and a cable 432 to a continuous contact ring 434 mounted on the carrier plate 416 radially inward of and concentric with the fixed contacts 414.

Fixed contacts 414 are electrically connected one at a time with contact ring 434 to provide a conductive path for an electric current to flow to the primer 124 of one of the cartridges 56 by a contact 436 carried by a rotor assembly 438. At one end contact 436 has an axially extending finger 440 which continuously bears on contact ring 434, and at the other end a radially extending wiper finger 442 which engages the fixed contacts 414 one at a time. Rotor assembly 438 has a hub 444 of an electrically insulating material which is fixed to a shaft 446 and has a slot 448 therethrough in which contact 436 is received. The contact 436 is yieldably urged into engagement with both contact ring 434 and the fixed contacts 414 by a spring 450 received in a central pocket in the hub 444. Rotor assembly 438 also has a cogwheel 452 fixed to shaft 446 and journaled for rotation in the bracket 422 and the cover 412. The rotor 438 is driven clockwise (as viewed in FIGS. 28 and 29) by a coil spring 454 fixed at one end to the cogwheel and the other end to the bracket 422.

The clockwise movement of the rotor assembly 438 is controlled by the cooperation of the cogwheel 452 with an escapement arm 456 which has spaced apart first and second teeth 458 and 460 and is pivotally mounted by a pin 462 fixed to the bracket 422. The rotor 438 is releasably restrained with wiper contact finger 442 disengaged from all the fixed contacts 414 by engagement of the tooth 458 of the arm 456 with a cog of the cogwheel 452. Rotor 438 is advanced by spring 454 so that the wiper finger 442 engages one of the fixed contacts 414 by pivotal movement of the escapement arm so that its one tooth 458 disengages and its other tooth 460 engages a cog of the cogwheel 452. The arm 456 is moved to this position against the bias of a spring 464 by the attraction between an energized electromagnet 466 secured to bracket 422 and an iron slug 468 fixed to the arm. An electric current is supplied to the magnet 466 simultaneously with the current supplied to the contact ring 434 through a cable 470 connected to the magnet and receptacle 420.

The drive spring 450 may be wound up by manually manipulating a handle 472 fixed to one end of the shaft 446, the other end of which is journaled in insulating plate 416, and retained therein by a snap ring. The particular chamber 254 to which the distributor assembly 410 is directing an electric current is indicated by the cooperation of a marker 474 on the handle 472 with a circumferentially spaced series of indicia and numerals 476 on cover 412. When in use, an electric current is supplied to the distributor assembly 410 through an electric cable and plug inserted into receptacle 430. The distributor assembly 410 operates to ignite cartridges 56 in chambers 254 in essentially the same manner as the distributor assembly 318 and, hence, this manner of operation will not be repeated.

Modified Cartridge Chamber and Valve Arrangements

FIG. 30 illustrates a modified cartridge chamber and valve arrangement in a main body 480 of an operator embodying this invention. Cartridges 56 are received in circumferentially spaced chambers 482 in the body 480, each of which communicates through passages 484 and 486 with the receiving chamber 70. The outer ends of the passages 484 and 486 are closed by plugs 488 and 490 threaded into the body. The flow of gases from each chamber 482 into the receiving chamber 70 to act on piston 72 is controlled by an associated valve 492 having a shank 494 slidably received in a blind bore 496 extending transversely completely across passage 486.

Valve 492 is yieldably biased to its closed position (as shown in FIG. 30) by a spring 498 in a counterbore 500 bearing downwardly on the valve. The valve 492 has a stem 502 which abuts the plate 260 when the valve shifts upwardly to its fully opened position against the bias of spring 498. Valve 492 has a groove 504 in its stem which aligns with passage 486 when the valve is fully opened to permit chamber 482 to communicate with the common receiving chamber 70. When a cartridge 56 is fired in one of the chambers 482, its associated valve 492 is opened by evolving gases under high pressure flowing through a passage defined by groove 506 in the body 480 and acting on a face 508 of the valve to force it open against the bias of the spring 498.

FIGS. 31 and 32 illustrate another modified valve and chamber arrangement in a body 510 of an operator embodying this invention. To minimize the size of the operator, body 510 has a plurality of circumferentially spaced cartridge chambers 512 nested with each other in each of two annular rows encircling the central common receiving chamber. The upper end of each chamber 512 is closed and a cartridge 56 retained therein by a closure ring 514 releasably secured to the body 510. Each chamber 512 communicates with common receiving chamber 70 through an associated passage 516 in the body 510. The outer end of each passage 516 is closed by a plug 518 threaded into the body.

The communication of each passage 516 with its associated chamber 512 is controlled by a normally closed valve 520 received in a counterbore 522 coaxial with and disposed below the chamber. Each valve 520 has a hollow shank 524 slidably received in a counterbore in a carrier plug 526 threaded into the lower end of the counterbore 522. Insertion and removal of the plug 526 is facilitated by its hex socket 528. The valve 520 has an inclined peripheral surface 530 urged into sealing engagement with a mating seat 532 in the body 510 by a spring 534 received in the shank of the valve and a blind bore in the plug 526.

When a cartridge 56 is ignited in a chamber 512, the evolving gases act on the upper face 536 of its associated valve 520 to force the valve open so that the gases can flow through the passage 516 and into the common chamber 70 to act on the piston 72. When these high pressure gases flow into the chamber 70, they also flow through the passages 516 associated with the other valves 520 and act on their lower inclined peripheral surfaces 538 thereby assuring that the gases do not enter the other cartridge chambers 512.

FIG. 33 illustrates a further modified form of a chamber and valve arrangement in a body 540 of an operator embodying this invention which also provides a very compact arrangement of the chambers and valves. Each cartridge chamber 542 is defined by a bore in which its associated control valve 544 is also slidably received within a bushing 546 disposed in the bore. When the valve 544 is open, the chamber 542 communicates with the common receiving chamber 70 through a central passage in the bushing 546 and an interconnecting passage defined by holes through the body 540 and the side wall of the bushing. To maintain these holes in coaxial relation, a tang 549 on the bushing 546 is received in a groove 550 in the body.

Valve 544 is engagable with a mating seat 551 in one end of the bushing 546 and is yieldably urged toward its closed position (as shown in FIG. 33) by a spring 552 received in the bushing and a central bore in a retainer plug 554 threaded into the body 540 and having a hex socket 556 to facilitate insertion and removal of the plug. To limit the movement of the valve 544 against the bias of the spring 552, a stop pin 558 is received in the plug 554, the interior of which is vented to the atmosphere through a port 560. Port 560 also enables the compressive force produced by the spring 552 to be checked without removing the plug 554. This may be accomplished by inserting a rod through the port 560 to move pin 558 against the bias of the spring. When a cartridge 56 is ignited in a chamber 542, its associated valve 544 is forced to its open position against the bias of the spring 552 by the evolving gases acting on the upper face 562 of the valve which permits the gases to flow through passage 548 into the receiving chamber 70 to act on the piston 72.

In all embodiments of the operator it is preferable that the pressure of the gases discharged from each cartridge chamber be substantially equal. This can be achieved by making the total volume of each cartridge chamber and its associated passages leading to the receiving chamber equal. This is facilitated by disposing the cartridge chambers in generally circumferentially spaced apart relationship about and equally radially from the common central receiving chamber with their axes extending generally parallel to each other.

I claim:

1. A propellant activated operator comprising a receiver body, a plurality of separate cartridge chambers in said body each constructed and arranged to receive a cartridge therein, a closure member carried by said body and constructed and arranged to close off the ends of said cartridge chambers through which cartridges can be inserted, a receiving chamber carried by said body, a separate passage associated with each of said cartridge chambers and constructed and arranged to connect each cartridge chamber with said receiving chamber, a valve associated with each cartridge chamber and its passage and constructed and arranged to be normally closed so that its cartridge chamber does not communicate with said receiving chamber and to open when a cartridge in its chamber is fired so that gases produced by the firing of the cartridge will pass from such cartridge chamber through its associated passage and into said receiving chamber, and firing means carried by said body and constructed and arranged to rapidly fire in sequence, cartridges received in said cartridge chambers of said body, said firing means having a distributor with a contact associated with each cartridge chamber and constructed and arranged to be in contact with an electrically energized primer of a cartridge received in said cartridge chamber, a plurality of second electric contacts each connected by an electric conductor with only one of said first contacts, a rotor having a rotor contact constructed and arranged to sequentially engage said second contacts to sequentially direct an electric current to said first contacts to fire cartridges received in said cartridge chambers in a predetermined firing order, a pawl carried by said rotor, a plurality of stops disposed in circumferentially spaced apart relationship about the axis of rotation of said rotor and each constructed and arranged to engage with said pawl to releasably restrain movement of said rotor when said rotor contact engages one of said second contacts, and an actuator associated with each said valve and constructed and arranged to be moved to a first position by opening of said valve to engage said pawl and release it from said stop to permit said rotor to be moved so that it is disengaged from all of said second contacts and to be moved to a second position by closing of said valve to disengage its actuator from said pawl to permit said rotor to be moved until said pawl bears on another stop to thereby engage said rotor contact with another of said second contacts.

2. A propellant activated operator comprising a receiver body, a plurality of separate cartridge chambers in said body each constructed and arranged to receive a cartridge therein, a closure member carried by said body and constructed and arranged to close off the ends of said cartridge chambers through which cartridges can be inserted, a receiving chamber carried by said body, a separate passage associated with each of said cartridge chambers and constructed and arranged to connect each cartridge chamber with said receiving chamber and its passage and constructed and arranged to be normally closed so that its cartridge chamber does not communicate with said receiving chamber and to open when a cartridge in its chamber is fired so that gases produced by the firing of the cartridge will pass from such cartridge chamber through its associated passage and into said receiving chamber, and firing means carried by said body and constructed and arranged to rapidly fire in sequence, cartridges received in said cartridge chambers of said body, said firing means having a distributor with a first electric contact associated with each cartridge chamber and constructed and arranged to be in contact with an electrically energized primer of a cartridge received in said cartridge chamber, a plurality of second electric contacts each connected by an electric conductor with only one of said first contacts, a rotor having a rotor contact constructed and arranged to sequentially engage said second contacts to sequentially direct an electric current to said first contacts to fire cartridges received in said cartridge chambers in a predetermined firing order, said rotor contact is constructed and arranged to rotate on an axis, said second contacts encircle said axis and are generally circumferentially spaced apart from each other, and a spring motor constructed and arranged to move said rotor contact to sequentially engage said second contacts.

3. The operator of claim 2 wherein said distributor and said spring motor are carried by said body.

4. The operator of claim 2 wherein said distributor also comprises a cogwheel constructed and arranged to be rotated by said spring motor in synchronization with said rotor contact, and spaced apart first and second teeth constructed and arranged to selectively engage circumferentially spaced apart cogs on said cogwheel to control rotation of said cogwheel and rotor contact by said spring motor.

5. The operator of claim 4 wherein said distributor also comprises an arm on which said first and second teeth are carried in spaced apart relationship and said cogwheel and arm are constructed and arranged such that when said first tooth engages a cog of said cogwheel, said rotor contact is disengaged from all of said second contacts and when said cogwheel is rotated by said spring motor so that said second tooth engages one of said cogs of said cogwheel, said rotor contact engages one of said second contacts to direct an electric current to the first contact electrically connected with said one second contact.

6. The operator of claim 5 wherein said distributor also comprises means yieldably biasing said arm to releasably engage its first tooth with a cog of said cogwheel, and an actuator operatively associated with said arm and having an electromagnet which, when energized, moves said arm to disengage its first tooth from said cogwheel and engage its second tooth with a cog of said cogwheel to permit said spring motor to move said rotor contact into engagement with one of said second contacts.

7. The operator of claim 2 wherein said distributor also comprises a pawl carried by said rotor, a plurality of stops disposed in circumferentially spaced apart relationship about the axis of rotation of said rotor and each constructed and arranged to engage with said pawl to releasably restrain movement of said rotor when said rotor contact engages one of said second contacts, an actuator associated with each said valve and constructed and arranged to be moved to a first position by opening of said valve to engage said pawl and release it from said stop to permit said rotor to be moved so that it is disengaged from all of said second contacts and to be moved to a second position by closing of said valve to disengage its actuator from said pawl to permit said rotor to be moved until said pawl bears on another stop to thereby engage said rotor contact with another of said second contacts.

8. The operator of claim 7 wherein each of said valves is moved to its open position by gases produced by firing a cartridge in its associated cartridge chamber.

9. The operator of claim 8 wherein said distributor and said spring motor are carried by said body.

10. The operator of claim 7 which also comprises a trigger switch for controlling the supplying of an electric current to said distributor which is constructed and arranged so when manually actuated, it closes a circuit to supply current to the distributor for a short period of time which terminates before the rotor contact is moved from one of said second contacts to another of said second contacts in response to movement of said actuator of the valve associated with the cartridge chamber in which a cartridge is fired by the current supplied to said distributor by the actuation of said trigger switch.

11. The operator of claim 10 wherein said trigger switch comprises a housing, a pair of electric contacts carried by said housing, at least one of said contacts being movable to place said contacts in conducting and non-conducting states, a hammer carried by said housing and constructed and arranged to move from a first position spaced from said contacts to a second position to strike at least one of said contacts and only momentarily cause said contacts to change state, an actuator constructed and arranged to yieldably normally position said hammer so that it is disengaged from said contacts, will permit said hammer to move from said normal position to a cocked position farther away from at least one of said contacts, and when said hammer is released from said cocked position, will cause said hammer to move toward and momentarily strike one of said contacts and then return to its normal position, a manually movable trigger carried by said housing, and a latch operatively associated with said trigger and said hammer to initially move said hammer from its normal position to its cocked position and then release said hammer to permit said hammer to be moved by said actuator toward and strike at least one of said contacts and then return to its normal position.

12. The operator of claim 11 wherein said latch comprises a member pivotally carried by said trigger and having a dog thereon which engages with said hammer to move said hammer to its cocked position, a cam carried by said housing and constructed and arranged to engage said lever when said hammer approaches its cocked position to cause said lever to pivot in response to further movement of said trigger to thereby disengage said dog from said hammer and release said hammer for pivotal movement from its cocked position to strike at least one of said contacts.

13. The operator of claim 12 wherein said individual contacts are uniformally spaced circumferentially and said distributor has a rotor having a contact constructed and arranged to successively engage and electrically energize said contacts when said rotor is rotatably indexed, and drive means responsive to actuation of said manually operable means to rotatably index said rotor.

14. The operator of claims 1 or 2 wherein said cartridge chambers are disposed in generally circumferentially spaced apart relationship about and encircling said receiving chamber with their axes extending generally parallel to each other.

15. The operator of claims 1 or 2 wherein the total volume of each of said cartridge chambers and its associated separate passage is substantially equal.

16. The operator of claim 1 wherein each of said valves comprises a valve member disposed in a bore spaced from and having its axis extending generally parallel to the axis of said cartridge chamber and constructed and arranged to move to a first closed position wherein such associated cartridge chamber does not communicate with said receiving chamber and to a second open position wherein such associated cartridge chamber communicates with said receiving chamber, means yieldably biasing said valve member to its first position, and said valve member having a face communicating with its associated cartridge chamber when said valve member is in said first position and being constructed and arranged so that gases produced by firing a cartridge in such associated cartridge chamber moves such valve member to its second position against the bias of said yieldable means so that such gases can flow into said receiving chamber.

17. The operator of claim 16 which also comprises a passage continuously communicating each of said cartridge chambers with the face of its associated valve member when said valve member is in its first position.

18. The operator of claim 2 which also comprises a holder constructed and arranged to releasably receive and retain a plurality of cartridges such that the cartridges can be inserted into said cartridge chambers in said body and said holder received between said body and said chamber closure member.

19. The operator of claim 2 wherein each of said valve comprises a valve member disposed in a bore spaced from and having its axis extending generally parallel to the axis of said cartridge chamber and constructed and arranged to move to a first closed position wherein such associated cartridge chamber does not communicate with said receiving chamber and to a second open position wherein such associated cartridge chamber communicates with said receiving chamber, means yieldably biasing said valve member to its first position, and said valve member having a face communicating with its associated cartridge chamber when said valve member is in said first position and being constructed and arranged so that gases produced by firing a cartridge in such associated cartridge chamber moves such valve member to its second position against the bias of said yieldable means so that such gases can flow into said receiving chamber.

20. The operator of claim 19 which also comprises a passage continuously communicating each of said cartridge chambers with the face of its associated valve member when said valve member is in its first position.

21. The operator of claim 2 wherein at least one of said valves comprises a movable valve member constructed and arranged to move to a first closed position wherein its associated cartridge chamber does not communicate with said receiving chamber and to a second open position wherein its associated cartridge chamber communicates with said receiving chamber, means yieldably biasing said valve member to its first position, and said valve member having a piston face in communication with its associated cartridge chamber when said valve member is in its first position with said piston face being constructed and arranged so that gases produced by firing a cartridge in such associated cartridge chamber produces sufficient force to overcome the bias of said yieldable means and move said valve member to its second position so that such gases can flow into said receiving chamber.

22. The operator of claim 21 which also comprises another passage placing said piston face of said valve member in communication with its associated cartridge chamber when said valve member is in its first position.

23. The operator of claim 21 which also comprises an adjustable flow control valve operatively associated with said passage communicating said piston face of said valve member with its associated cartridge chamber when said valve member is in its said first position, and constructed and arranged to control the rate of flow of gases to said piston face of said valve member.

* * * * *